United States Patent [19]

Elbe et al.

[11] 4,058,922

[45] Nov. 22, 1977

[54] RIFLE ADAPTER ASSEMBLY

[75] Inventors: Ronald E. Elbe, Davenport, Iowa; Donald W. Krolak, Rock Island; Philip L. Vernon, Milan, both of Ill.

[73] Assignee: The United States of America as represented by the Secretary of the Army, Washington, D.C.

[21] Appl. No.: 617,203

[22] Filed: Sept. 26, 1975

[51] Int. Cl.[2] ..... F41C 11/00; F41C 21/10; F41C 25/00

[52] U.S. Cl. ..... 42/16; 42/49 A; 42/69 B; 89/29

[58] Field of Search ..... 42/16, 49 A, 69 B, 77; 89/29

[56] References Cited

U.S. PATENT DOCUMENTS

| | | | |
|---|---|---|---|
| 2,900,877 | 8/1959 | McClenahan | 42/69 B |
| 3,044,203 | 7/1962 | Wilhelm et al. | 42/69 B |
| 3,079,718 | 3/1963 | Allyn | 42/69 B |
| 3,771,415 | 11/1973 | Into et al. | 42/49 A |
| 3,776,095 | 12/1973 | Atchisson | 42/49 A |

FOREIGN PATENT DOCUMENTS

| | | | |
|---|---|---|---|
| 1,166,052 | 3/1964 | Germany | 42/49 A |

*Primary Examiner*—Charles T. Jordan

*Attorney, Agent, or Firm*—Nathan Edelberg; Harold H. Card, Jr.; Robert O. Richardson

[57] ABSTRACT

A conversion system is disclosed for adapting a rifle to fire ammunition of different shape or type than that for which the rifle was designed. The conversion system includes a modified bolt with suitable supports for mounting the same in a rifle receiver in place of the standard rifle bolt. A novel magazine is included for cooperative action with the modified bolt to assure accurate feeding of the different ammunition. Safety features such as prevention of double firing and open bolt retention for inspection after firing the last round is emphasized. Bolt carrier travel on recoil to insure cocking is less than that required to feed the next round into the chamber to prevent double firing. A vertical surface on the bolt engages the rifle's bolt catch to hold the bolt out of battery for visual inspection of the rear of the rifle chamber.

6 Claims, 9 Drawing Figures

RIFLE ADAPTER ASSEMBLY

GOVERNMENT RIGHTS

The invention described herein may be manufactured and/or used by or for the Government for governmental purposes without the payment of any royalty thereon.

BACKGROUND OF THE INVENTION

Unlike rifles used for hunting wild game for sport, standard firearms used by military services are typically designed for use against human targets, at long range, and with precise accuracy. The ammunition best suited for the foregoing requirements is usually not large in caliber of the projectile, but having a shell casing adapted to holding a large quantity of powder. Such ammunition, as used for most military firearms, is of the center fire type requiring a small ignition cap mounted at the center in the base of each round to ignite the main powder charge.

The manufacturing cost of ammunition such as that described above is understandably high, and involves larger quantities of metal and powder than would small rounds such as the familiar .22 caliber rounds widely used for hunting small game and for inexpensive target-practice by the general public. The latter type of ammunition characteristacally has a volume of powder not much larger than the volume of the projectile itself, and has no cap in the shell base since it is rim fired. For training purposes, where simple handling and target practice with military firearms is taught to recruits, it would obviously be a very substantial saving in dollars as well as conservation of materials if such firearms could be adapted to use very small caliber ammunition in place of the lethal type for which the weapons were originally designed. Moreover, smaller and more accessible firing ranges are adequate for training when the smaller ammunition is used.

A Rifle Conversion Assembly U.S. Pat. No. 3,771,415 issuing to Henry A. Into et al Nov. 13, 1973, and a Weapon Conversion Bolt Assembly Device U.S. Pat. No. 3,776,095 issuing to Maxwell G. Atchisson, Dec. 4, 1973, relate to devices for converting a firearm of one caliber to one of a smaller caliber. They provide for a unitary bolt assembly that may be substituted for the standard bolt assembly in the weapon. They include a conversion chamber adapter with a bolt mounted for movement between recoil and battery positions. They each have a backplate damper to assist in maintaining the operating components in assembly and to absorb recoil impact energy of the bolt upon firing of the weapon. The bolt slides longitudinally between the conversion chamber and the backplate damper. An extractor and firing pin ride on the bolt and an ejector is positioned on the assembly frame to eject cartridge casings as the bolt recoils rearwardly when a cartridge has been fired.

The foregoing conversion assemblies, however, do not satisfy two safety requirements in that they may cause double firing and the rear of the rifle chamber cannot be visually inspected at the end of firing since their bolts cannot be held out of battery position.

SUMMARY OF PRESENT INVENTION

In accordance with the present invention an adapter is provided for using ammunition other than for which the weapon was intended. This adapter comprises an assembly having a rear retainer 42 with buffer 46 and a forward adapter chamber 40 held in spaced apart relationship by means of a supporting rail 30 and guide rod 32. Reciprocably mounted for linear slidable movement on rail 30 and rod 32 is a bolt 28 which is urged forwardly against the adapter chamber 40 by a helical spring 38 which is positioned over rod 32 and which bears against retainer 42 and the bolt 28. A cartridge extractor 62 is pivotally mounted and a firing pin 54 is slidably mounted on bolt 28. An ejector 70, is positioned on the supporting rail 30. A novel magazine 80 is used which has elongated feed lips 82, rim slope 150, and a chambering ramp 84, (in FIG. 2) to chamber a cartridge when engaged by rammer 76 on the bolt 28 as it moves to battery position. A cartridge cannot be chambered, however, until the bolt has moved rearwardly past its position for cocking.

Because of the small size of the ammunition used, such as 22 caliber for example, bolt 28 is blowback operated. It is not locked in battery position but recoils rearwardly upon firing.

Upon firing round 18, the same force which propels projectile 24 forward through the rifle barrel 16 also reacts to force cartridge case 22 of the round 18 rearwardly against the face of bolt 28 forcing the bolt toward the rear. Bolt 28 bears against hammer 50 and rotates the hammer backward into cocked position during recoil of the bolt, where it is seared on trigger 48. After the recoil force is spent, such as by bolt 28 impacting against buffer 46 the bolt moves forward toward battery position. During this movement, a lower projecting ridge 76 or rammer on the bottom of bolt 28 engages a round 78 releasably held in magazine 80 and moves it up a ramp on the magazine 80 and into the chamber.

At the end of a practice session the range officer requires that the bolt 28 be held open so that a visual inspection will show the chamber to be empty. Activation of a button on the rifle for this purpose will cause the bolt catch 92 on the rifle to engage a vertical surface 96 on the bolt to hold it in open position.

Another safety feature is the inertia firing pin 54 which strikes cartridge shell 22 only when hammer 50 has been released. A jarring of the rifle cannot cause it to discharge.

DESCRIPTION OF A PREFERRED EMBODIMENT

Figure 1:
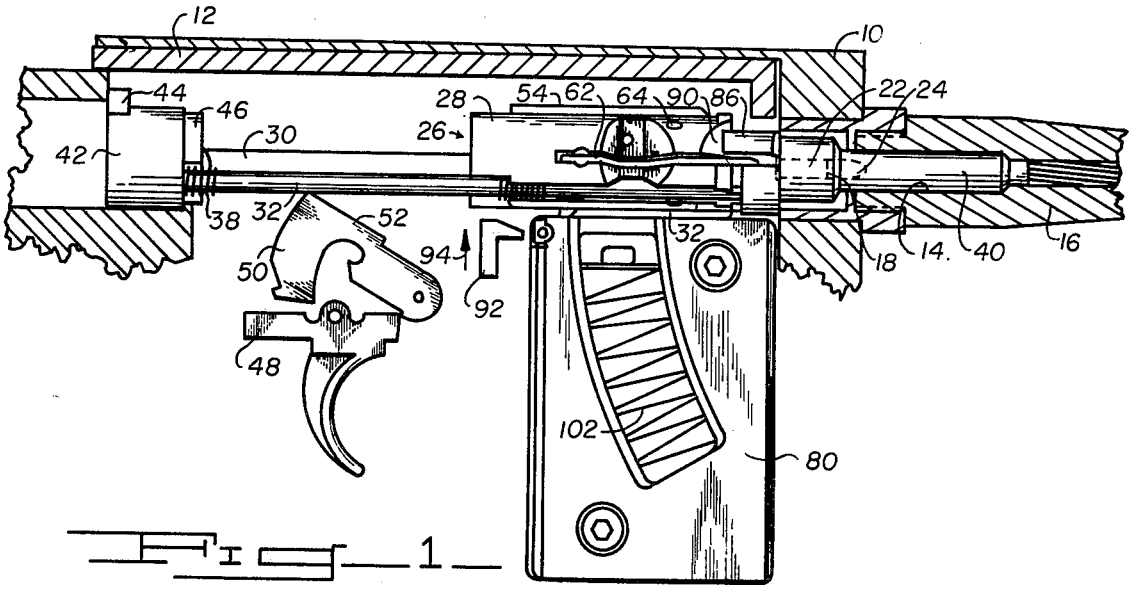
FIG. 1 shows a side elevational fragmented view, partly in cross section, of the inventive device positioned in a rifle with the bolt in the battery position and the hammer cocked.

While the invention may be used in a variety of different sizes or configuration of weapons, it will be described illustratively in connection with a rifle 10 of any suitable standard design. This rifle may be gas operated, blowback operated or be of any other bolt action type. Referring to FIG. 1, such a rifle 10 has a receiver 12 normally containing a bolt assembly (not shown) adapted to seat against a firing chamber 14 at the breech end of barrel 16. The firing chamber is naturally sized to receive a round of ammunition having a relatively large shell casing and a much smaller projectile fitted thereon.

Figure 3:
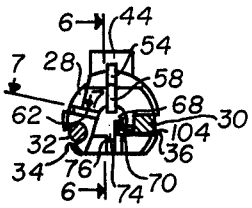
FIG. 3 shows an isolated front elevation view partly in cross section of the novel adapter assembly, taken along the line 3—3 in FIG. 2.

To adapt this rifle 10 for use with ammunition 18 of different size than that designed for firing chamber 14, particularly characterized by a much smaller shell casing 22 and either substantially or exactly the same size projectile 24 the bolt normally used in rifle 10 is removed and replaced by the present bolt assembly 26. Assembly 26 includes a bolt 28 supported for linear reciprocating movement generally between supporting rail 30 and guide rod 32. This is accomplished by grooves 34 and 36 cut into generally opposite sides of bolt 28 having suitable size and contours for sliding engagement with the rail and rod, respectively, as seen in FIG. 3. A spring 38 on rod 32 biases bolt 28 forwardly.

Rail 30 and rod 32 are secured at one end to a chamber adapter 40 sized to fit within firing chamber 14 of rifle 10 and at the other end to a retainer 42. Retainer 42 is adapted to be securely retained inside the receiver 12 of rifle 10 and to this end has alignment lug 44 integrally formed or otherwise mounted on retainer 42. Lug 44 also prevents rearward movement of the assembly 26. A buffer 46 secured to retainer 42 serves to react the recoil force of bolt 28 when a round is fired. After chambering a round 18 in the breech of adapter 40, firing is accomplished by squeezing trigger 48 of rifle 10. This releases spring-loaded hammer 50 so that bearing surface 52 on the hammer impacts one end of firing pin 54 which is slidably contained in bolt 28 and urged rearwardly by suitable biasing means such as spring 56 (shown in FIG. 6). Upon impact of pin 54 on the rim of shell casing 22 the biasing force of spring 56 is overcome and the momentum of firing pin 54 carries the pin forward until the front edge 58 thereof impacts the rim of the chambered round 18. It should be noted that pin 54 continues to move forward to strike cartridge 18 after forward movement of hammer 50 has stopped by striking a back surface 60 on bolt 28. While the front edge 58 of pin 54 is adapted to strike the rim of the cartridge 18, it would be obvious to adapt it to strike the center of the casing end if center firing cartridges were used.

Figure 7:
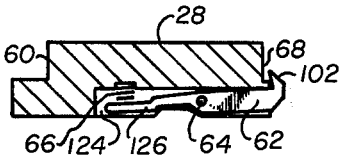
FIG. 7 shows an isolated fragmented view taken along line 7—7 in FIG. 3.

An extractor 62 of familiar type is mounted on bolt 28 for relative pivoting movement about a pin 64 and is biased toward the longitudinal center line of the elongate bolt 28 by a spring 66 shown in FIG. 7. The firing of a round causes reaction force to be applied to the shell casing 22 of round 18 (see FIG. 8) which then exerts rearward pressure upon recessed face 68 of bolt 28, pushing the bolt 28 backward towards buffer 46. During this movement, bolt 28 reaches a place at which a laterally projecting ridge 70 on rail 30 is exposed, interfering with the path of movement of the shell casing 22 which is engaged by extractor 62. The impact of ridge 70 on the base shell 22 combined with the holding action of the extractor 62 causes the shell to be ejected out of receiver 12. It may be useful, if desired, to form lands and grooves (not shown) on the inner surface 72 of chamber adapter 40.

Figure 2:
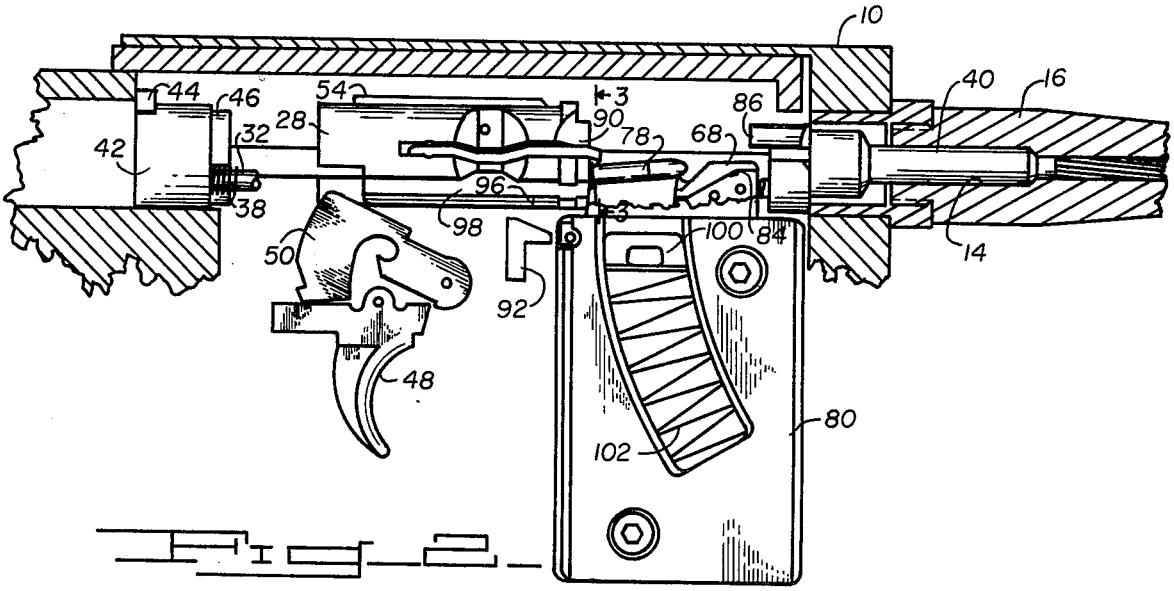
FIG. 2 shows a view corresponding with FIG. 1 but with the bolt at the feed position and with the hammer cocked.

Continued recoil movement of bolt 28 recocks hammer 50 by counter clockwise rotation thereof in the view shown FIG. 2. Thereafter, bolt 28 bounces off buffer 46 and begins its forward travel. When the forward edge 74 of downwardly depending ridge 76 on bolt 28 reaches the location of the top round 78 in magazine 80, as bolt 28 moves forwardly, the stated edge 74 engages the rear surface of the round and pushes it forward. Channel means in the form of feed lips 82 and guiding means in the form of an angularly disposed ramp 84 mounted on magazine 80 (see FIG. 9) generally between lips 82 serve to control and guide round 78 into chamber adapter 40.

During the last increment of movement when bolt 28 is about to reach full battery position extractor 62 often makes contact with the breech end of chamber adapter 40, causing just enough misalignment of bolt 28 relative to round 78 so that the base of the round fails to seat properly in the recessed face 68 of bolt 28. To avoid such misalignment, a lug or projection 86 having a contoured bearing surface 88 is mounted on adapter 40. An oppositely contoured bearing surface 90 is formed on the portion of bolt 28 which contacts surface 88. During the mentioned final increment of forward travel of bolt 28, lug 86 bears against surface 90 so that bolt 28 is restrained by the lug against any lateral or angular displacement, insuring that proper seating of the base of round 78 in recessed face 68 of bolt 28 will inevitably occur after round 78 is otherwise chambered or substantially contained in chamber adapter 40.

At the end of the firing session the training officer requests that bolt 28 be held in the open position to permit visual inspection of chamber 14 to be sure it has no cartridges. To do this a button on the rifle (not shown) is actuated and rifle bolt catch 92 on the rifle moves upwardly in the direction of arrow 94 to engage a vertical bolt stop surface 96 on ridge 98 on bolt 28 when the bolt is retracted.

FIG. 2 is similar to FIG. 1 except that bolt 28 is in a position to move forwardly to battery position, chambering the top round 78 in magazine 80. Magazine 80 contains a plurality of cartridges above follower 100 and urged upwardly by spring 102.

FIG. 3 is a sectional view taken along line 3—3 in FIG. 2. Here can be seen the grooves 34,36 in bolt 28 in which guide rod 32 and support rail 30 are positioned. Recessed face 68 of bolt 26 has an upper slot in which front edge 58 of firing pin 54 translates. Also the hook portion 102 of extractor 62 extends over a portion of it. This recessed face 68 is adapted to receive a cartridge shell casing from forward edge 74 of the rammer ridge 76 at the lower end of the face 68 as the bolt 28 moves forwardly and the cartridge moves up the ramp 84 of the magazine 80 in FIG. 2. When this occurs, hook 102 engages the cartridge rim and bears it snuggly against the arcuate recess wall 104 diametrically opposite the extractor 62. This arcuate recess wall 104 preferably has an annular groove to receive the outer edge of the cartridge rim. This along with extractor hook 102, retains the cartridge against the recess face 68 until the cartridge shell strikes the ejector ridge 70 on guide rail 30, which occurs during rearward bolt travel upon blowback after the cartridge has been fired.

Figure 4:
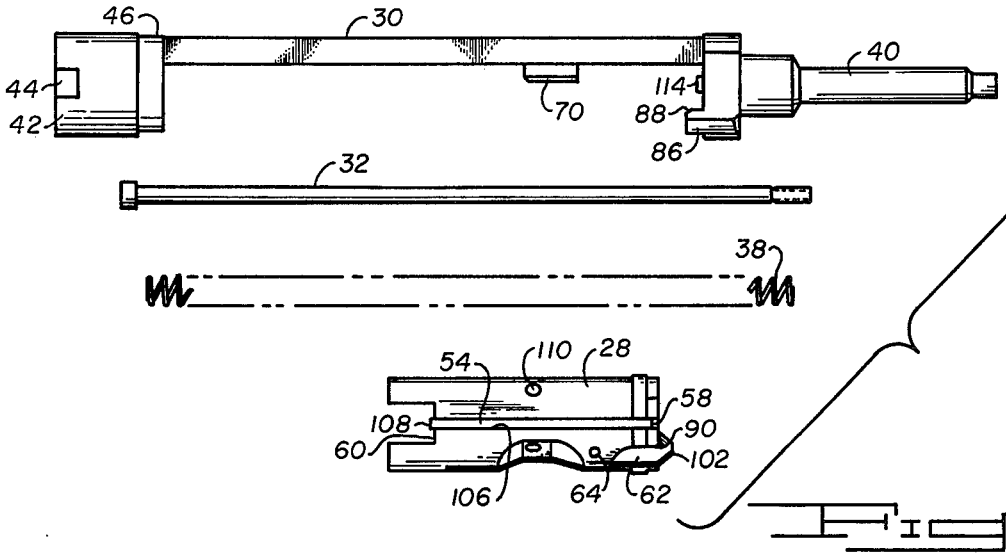
FIG. 4 shows an exploded view of the adapter assembly seen in FIGS. 1, 2, and 3.

FIG. 4 shows in plan an exploded view of the adapter assembly. Here the chamber adapter 40, supporting rail 30, retainer 42 and buffer 46 are shown as one part not intended for further disassembly. Guide rod 32 and spring 38 are disconnected and released from this assembly to free the bolt 28 from its sliding engagement with rail 30 and rod 32.

An appropriate longitudinal slot is provided in bolt 28 for extractor 62 to pivot on pin 64. The extractor hook 102 extends forwardly of the recessed face 68. Firing pin 54 translates fore and aft in longitudinal slot 106 with spring 56 urging the pin rearwardly so that the pin rear end 108 extends beyond the back surface 60 of bolt 28. A pin 110 passes through a slot 112 (shown in FIG. 6) in firing pin 54 to prevent its disengagement.

Figure 8:
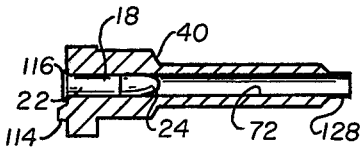
FIG. 8 shows an isolated cross-sectional view of the adapter chamber.

Chamber adapter 40 has a lower ledge 114, shown also in FIG. 8, which supports the rim 116 of cartridge shell 22 when it is chambered and ready for firing.

Figure 5:
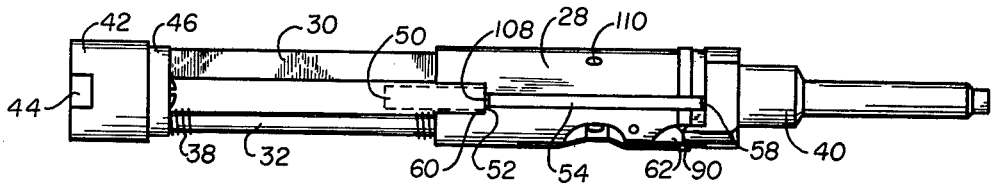
FIG. 5 shows a top plan view of the structure shown in FIG. 3, with the bolt in the full battery position with the firing pin moving forward in response to hammer impact.

FIG. 5 shows in plan view the completed assembly ready for use. It is to be noted that the rifle hammer 50 rotates between rail 30 and rod 32 and, in its forward position, strikes first the rear end 108 of firing pin 54 and thereafter seats against back surface 60 of bolt 28. As mentioned previously, firing pin 54 is of the inertia type wherein impact of hammer 50 must be such that the firing pin 54 continues its forward movement after leaving the hammer 50 and its leading edge 58 then impinges the cartridge rim, causing the cartridge to fire.

Figure 6:
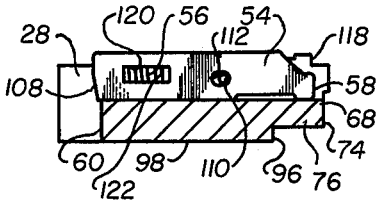
FIG. 6 shows an isolated fragmented view in cross section taken along line 6—6 in FIG. 3.

FIG. 6 is a sectional view taken along the line 6—6 of FIG. 3. Here is shown bolt 28 with its lower ridge 98 which rides between the lips 82 of magazine 80 as the front surface 74 rams the top cartridge in the magazine into the firing chamber of the adapter. Below and rearwardly of the forward edge 74 is the bolt stop 96 which engages bolt catch 92 on the rifle in keeping the bolt in its rearward hold-open position for visual chamber inspection. Shoulder 118 at the front end of bolt 28 is for making contact with the rifle charging handle, not shown, for moving the bolt rearwardly to initiate firing operation.

Firing pin 54 consists of a vertical elongated flat plate of less length than the distance between the bolt back surface 60 and the bolt recessed face 68. An elongated aperture or slot 112 with a pin 110 protruding through it and into the bolt 28 retains pin 54 and permits its longitudinal movement. A spring 56 seated in opening 120 of pin 54 and bearing against bolt surface 122 continually urges firing pin 54 in its rearward position, as shown.

FIG. 7 is a sectional view taken along the line 7—7 of FIG. 3, showing how extractor 62 is fastened to bolt 28. The extractor fits into a longitudinal, radially extending slot 124 and is pivotally mounted on bolt 28 by pin 64. The rear end 126 of extractor 62 is urged outwardly by spring 66. This keeps extractor hook 102 over the edge of recessed face 68 of the bolt 28 to retain a cartridge shell against the face during bolt movement.

FIG. 8 is a vertical sectional view along the axis of adapter 40, showing an inner fore surface 72 and cartridge 18 in battery position ready for firing. Surface 72 may be rifled, if desired, to increase blowback compression. Neck 128 may be eliminated in some applications.

Figure 9:
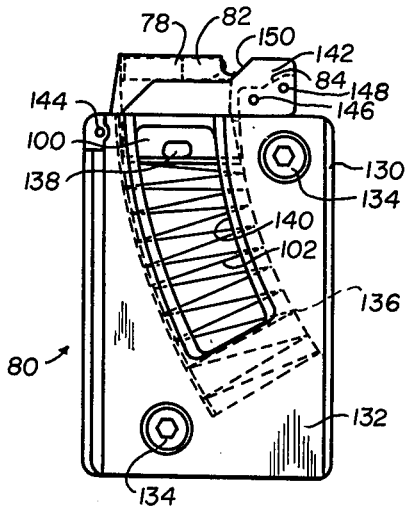
FIG. 9 shows an isolated side elevational view of the magazine structure used with the adapter assembly.

FIG. 9 is an elevational view of magazine 80. This magazine consists of a plastic case consisting of two sections. One section 130 has a back, both ends, bottom and ramp 84. The other section is a front plate 132 bolted to the other section by means of bolts 134. The back has a recessed portion or cartridge holder cavity shown by dashed lines 136. A spring 102 and follower 100 fits within this cavity. Follower 100 has a manual press handle 138 which protrudes out from window 140 so that follower 100 may be depressed downwardly as cartridges are loaded or unloaded from the top. Metallic feed lips 82 and guide 142 are fastened at the top of the magazine at fastener points 144, 146, and 148. A cartridge 78 is shown between the lips 82 and above follower 100, ready to be fed between guides 142 and up ramp 84 and into the adapter chamber.

Loading and unloading magazine 80 is remarkably simple, easy and fast. With the magazine held in the loader's left hand the loader can depress follower 100 a cartridge width at a time with his left thumb on handle 138. With his right hand the loader inserts cartridges 78, rim first between guides 142 with the rim riding down slopes 150 and rearwardly under the upper inturned edges of lips 82. As each cartridge is fed under the lips, the handle 138 is depressed another cartridge width so there is never any spring urged tension of the cartridge against the lips. The magazine is thus loaded very quickly.

The magazine can be emptied even more quickly. The magazine is simply tilted about 45° (clockwise in FIG. 9) and handle 138 depressed and released a multiple of times as the cartridges are released from spring tension against the lips and slide down ramp 84, with the shell rim riding along slope 150, and free from the magazine.

It is a significant feature of the invention disclosed herein that the dimensional relationship between certain of the details described above is carefully established to prevent doubling, tripling, or runaway gunfire of rifle 10 when using the adapter assembly of the present invention. Doubling refers to a condition wherein one squeeze of trigger 48, instead of firing only one round, fires two in rapid succession. Three such rounds for one trigger squeeze is tripling. Both conditions can result from use of a weak round lacking the proper quantity of powder in the shell or having too loose a fit between the projectile and the shell, whereby the recoil force applied to bolt 28 is substantially less than with proper rounds. However, hammer 50 in rifle 10 is normally cocked automatically during recoil travel of the bolt mechanism. This may require as much 1.8 inches or more of bolt carrier travel to cock hammer 50. Feeding of ammunition from magazine 80 also occurs automatically but during the forward movement of bolt 28 after recoil has occurred. Use of this assembly with very short rounds, say one inch long ammunition, would mean that bolt 28 could engage a fresh round and chamber the same in firing position with little more than one inch of recoil movement. Thus, the amount of recoil movement necessary to engage and chamber a new round is less than the amount of recoil movement necessary to recock hammer 50.

When a weak round fires, bolt 28 may recoil just past the feed position where forward edge 74 on ridge 76 on the bolt begins to push round 78 into the firing chamber. If at this point bolt 28 has not recoiled far enough to recock hammer 50, the hammer will remain in contact with the back surface of bolt 28 and, if firing pin 54 were not of the floating type, would push the firing pin forward to fire the round as soon as the bolt reaches battery position.

To avoid the foregoing phenomena, magazine 80 just described has been provided with the extra long feed-lips 82 designed to insure that bolt 28 must move back farther during recoil to engage round 78 than the amount of bolt movement necessary to cock hammer 50. In addition, firing pin 54 is shorter than the length of bolt 28 whereby a steady push on the rearmost edge 108 of the pin by hammer 50 will not suffice for the forward edge 58 to strike and thus fire a round. The foregoing construction, besides simplifying manufacture and lessening cost of magazine 80, adapts the magazine to use with considerably smaller ammunition than rifle 10 was designed to use, and in a manner such as to prevent doubling or tripling through the causes described above.

Having described an illustrative embodiment of the present invention, modifications will appear obvious to those skilled in the art and it is to be understood that these variations are to be considered as part of the present invention as claimed.

What is claimed is:

1. A rifle adapter system for converting a rifle having a rifle receiver to fire ammunition other than for which it was designed to fire, said adapter system comprising:

an adapter magazine attachable to said rifle for conveying adapter cartridges to said rifle receiver, said magazine having feed lips extending approximately the length of an adapter cartridge and an angularly disposed integral ramp extending forwardly therefrom, with side guides adjacent said ramp to guide said adapter cartridges when moved forwardly to battery position, an assembly having a rear retainer and forward adapter chamber held in fixed spaced relationship by a bolt supporting means, a bolt slidably moveable along said supporting means and between said retainer and said adapter chamber, said bolt having means thereon for moving an adapter cartridge into said chamber and extract the casing after said adapter cartridge has been fired, said bolt having a firing pin slidably mounted thereon for striking said adapter cartridge when in said chamber to fire the same, spring means on said bolt supporting means urging said bolt forwardly to a battery position, said rifle having a hammer and trigger for searing said hammer in cocked position, said bolt being operable on recoil to move said hammer to said cocked position, said hammer, bolt and magazine being so positioned, arranged and disposed that said bolt cocks said hammer on recoil before recoiling back far enough to feed a fresh adapter cartridge toward said chamber as said bolt advances to said battery position and thereby prevent double firing.

2. A rifle adapter system as set forth in claim 1 wherein said bolt supporting means includes a supporting rail and a guide rod, and said guide rod has said spring means thereover.

3. A rifle adapter system as set forth in claim 2 wherein said rail is integral with and rigidly connects said retainer with said adapter chamber and said guide rod is removeably connected therebetween.

4. A rifle adapter system as set forth in claim 1 wherein said firing pin is an inertia firing pin for rim firing of an adapter cartridge in said adapter.

5. A rifle adapter system as set forth in claim 1 wherein said bolt supporting means has a casing ejector thereon for ejecting said casing as said bolt recoils from its forward battery position adjacent said adapter chamber upon firing of a cartridge therein.

6. A rifle adapter system as in claim 1 including cartridge rim riding slopes forwardly of said feed lips to facilitate feeding adapter cartridges into and from said magazine.

* * * * *